United States Patent [19]

Aida

[11] Patent Number: 5,036,973

[45] Date of Patent: Aug. 6, 1991

[54] KIT FOR PACKING WRITING UTENSILS, NOTE PADS AND OTHER ACCESSORIES

[75] Inventor: Masaaki Aida, Tokyo, Japan

[73] Assignee: Midori, Co. Ltd., Tokyo, Japan

[21] Appl. No.: 282,197

[22] Filed: Dec. 9, 1988

[51] Int. Cl.[5] ..... A45G 11/34

[52] U.S. Cl. ..... 206/214; 206/224; 206/232; 206/473; 206/1.7; 206/575

[58] Field of Search ..... 206/214, 224, 232, 473, 206/1.7, 575

[56] References Cited

U.S. PATENT DOCUMENTS

| | | | |
|---|---|---|---|
| 3,126,891 | 3/1964 | Caputi | 206/214 |
| 4,318,471 | 3/1982 | Hutton | 206/214 |
| 4,802,575 | 2/1989 | Martin | 206/214 X |

FOREIGN PATENT DOCUMENTS

| | | | |
|---|---|---|---|
| 76808 | 9/1948 | Czechoslovakia | 206/214 |
| 68464 | 1/1949 | Denmark | 206/214 |
| 801576 | 1/1951 | Fed. Rep. of Germany | 206/214 |
| 3729572 | 4/1988 | Fed. Rep. of Germany | 206/214 |
| 638507 | 2/1928 | France | 206/214 |
| 1085354 | 7/1954 | France | 206/232 |
| 355571 | 8/1961 | Switzerland | 206/214 |
| 4412 | of 1893 | United Kingdom | 206/214 |

*Primary Examiner*—William I. Price
*Attorney, Agent, or Firm*—Morrison Law Firm

[57] ABSTRACT

A kit assembly for packing writing utensils and the like comprises a body hingedly connected to a lid member. The body includes a writing utensil which is a mechanical pencil with an integral ball-point pen in one end thereof, a holder for the writing utensil, which holder is fixable at a desired angle, a note holder placed in a binder mechanism holder, and the lid member includes upper and lower packing bodies hingedly connected in a similar manner as mentioned above, upper and lower pocket portions adapted to receive cards, etc., a so-called marker ruler designed to be slidably removable and a holding piece for holding clips, stamps and so on both being disposed on the back sides of the packing bodies. Male and female latch members are formed on the edges of the body and the lid member.

3 Claims, 4 Drawing Sheets

KIT FOR PACKING WRITING UTENSILS, NOTE PADS AND OTHER ACCESSORIES

BACKGROUND OF THE INVENTION

The present invention relates to a novel kit adapted to compactly pack therein various articles such as writing utensils.

Heretofore, various kits have been available for packing therein writing utensils, etc. However, such existing kits are designed to pack therein only a few articles, typically writing utensils. Not until now has there been available a packing kit of a novel structure capable of packing therein various articles including writing utensils.

SUMMARY OF THE INVENTION

In view of the foregoing, an object of the present invention is to provide a very convenient kit adapted to compactly pack therein various articles.

According to the present invention, this object is achieved by the provision of a kit assembly for packing writing utensils and the like, which comprises a body hingedly connected to a lid member, said kit including a writing utensil which is a mechanical pencil with an integral ball-point pen in one end thereof, a holder for said writing utensil, which holder is fixable at a desired angle to form a stand, a note holder placed in a binder mechanism detachably carried in the body, and a memo pad detachably attached to the inside of said body; and a memo pad detachably attached to the inside of said body; and said lid member including upper and lower covering members hingedly connected to the body, upper and lower pocket portions, formed in the lid member, adapted to receive cards etc., a marker ruler designed to be slidably removable and a holding piece for holding clips, stamps and so on, both being disposed on the back sides of said covering members, and which further includes mating male and female latch members formed on the edges of said body and said lid member.

With the packing kit of the aforesaid construction, a number of various articles packed in both the body and the lid member can be utilized in a very convenient manner. The packing kit itself can be carried in a compact manner and conveniently utilized in a wide range of places.

BRIEF DESCRIPTION OF THE DRAWINGS

The present invention will now be described, by way of example, with reference to the accompanying drawings in which.

DETAILED DESCRIPTION OF THE PREFERRED EMBODIMENT

The packing kit of the present invention comprises a body 1 hingedly connected at 3 to a lid member 2.

Figure 1:
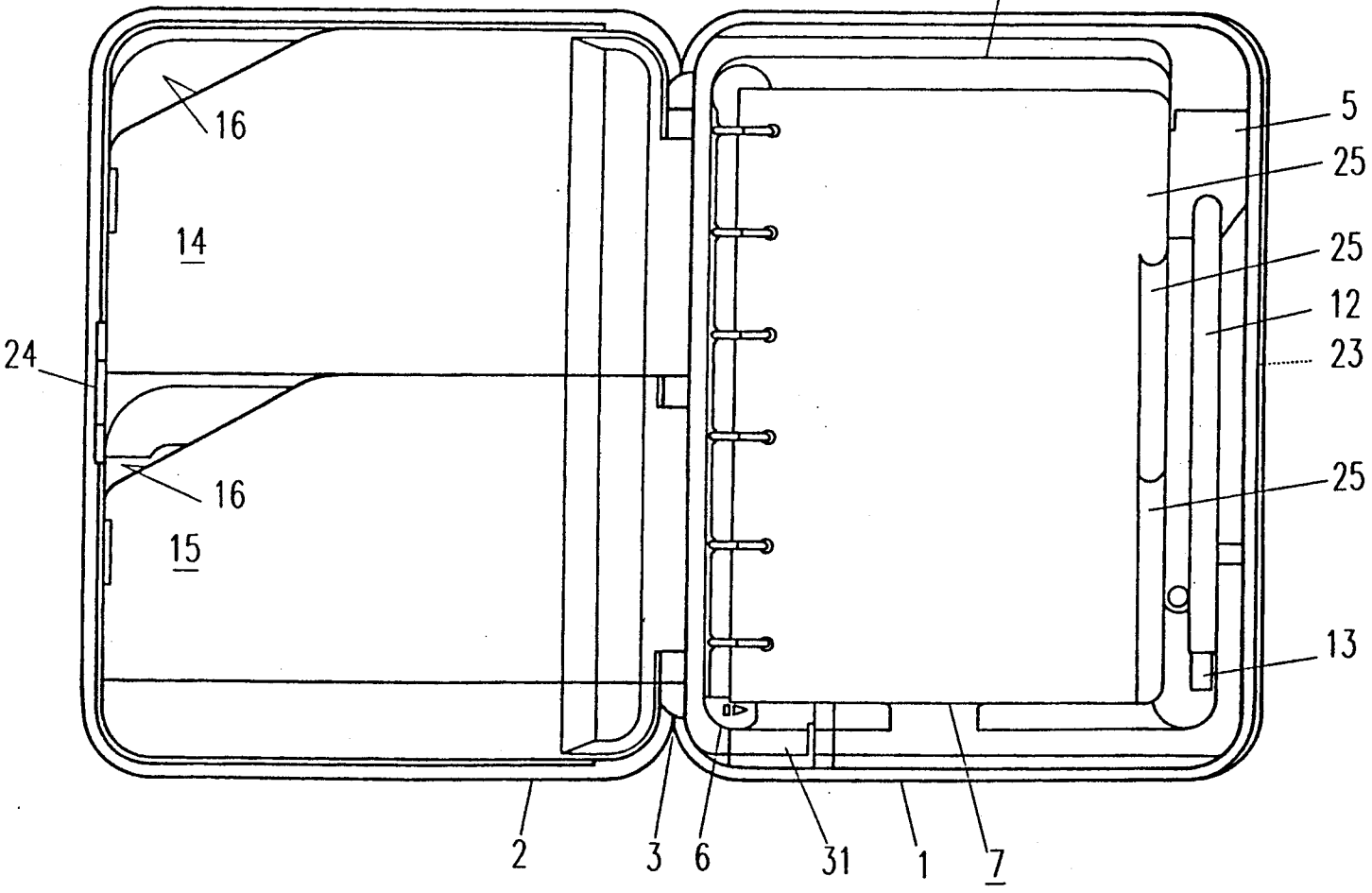
FIG. 1 is a front view of one embodiment of the packing kit according to the present invention in an open state.
Figure 3:
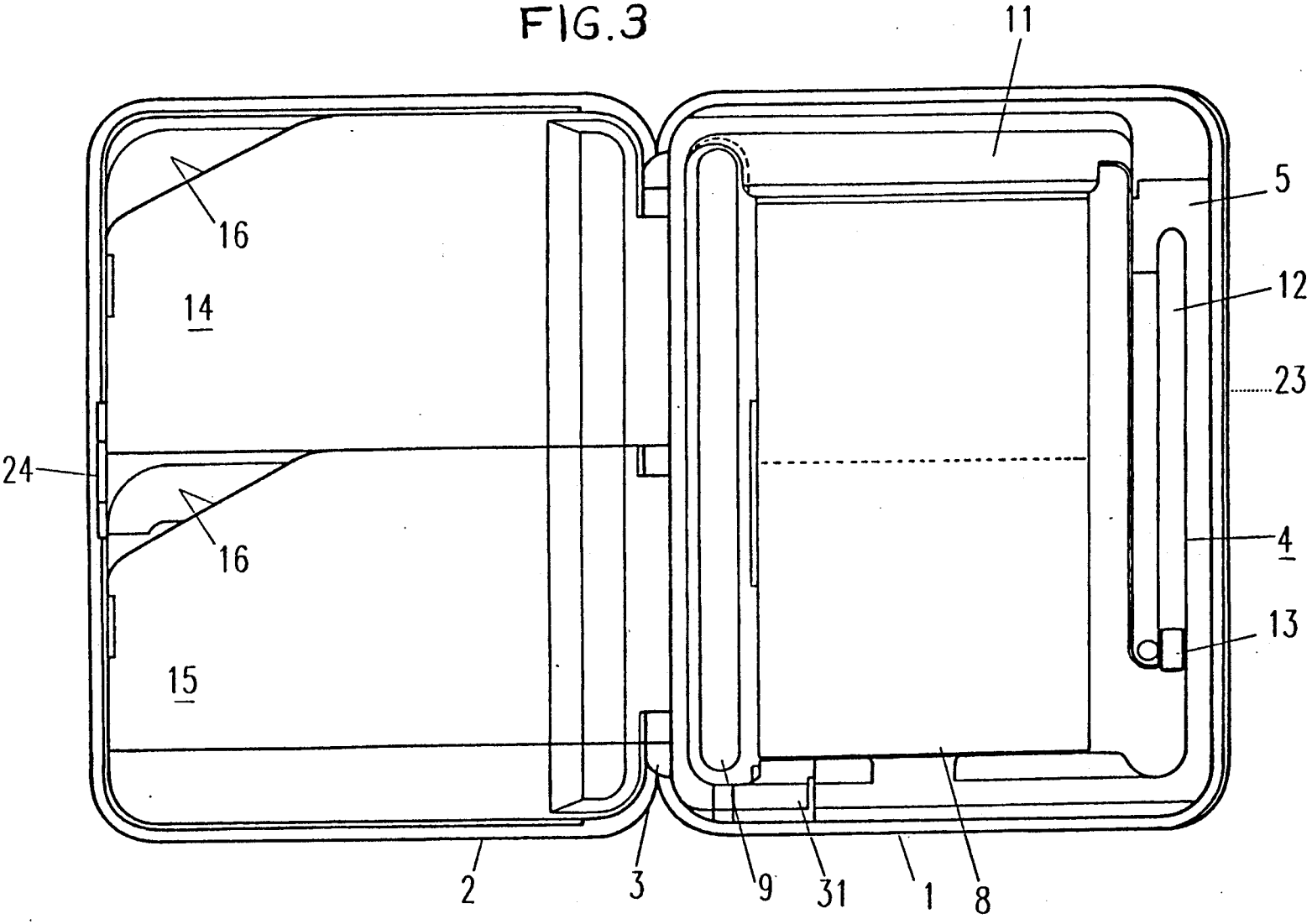
FIG. 3 is a front view of the packing kit of FIG. 1 from which the note holder has been removed.
Figure 4:
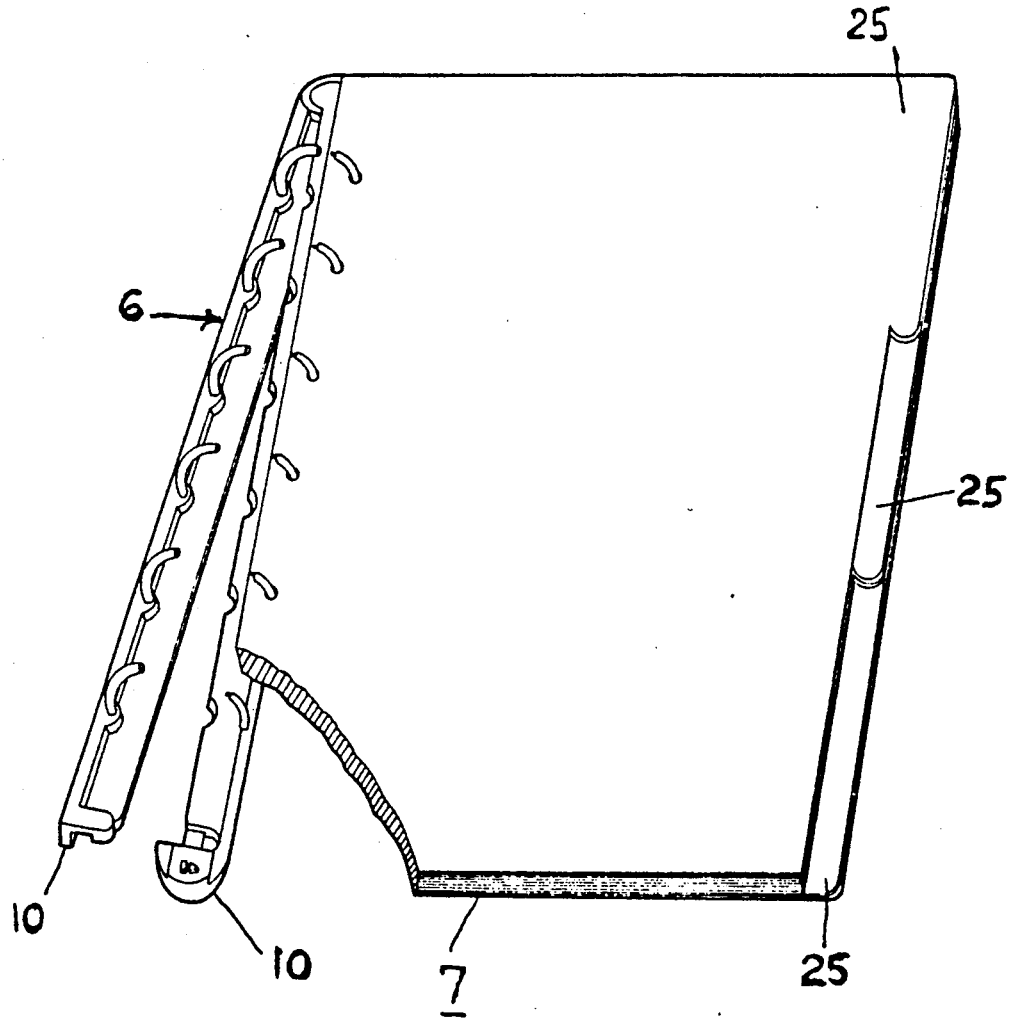
FIG. 4 is a perspective view of the note holder.

As illustrated in FIG. 1, the body includes a writing utensil 4 which is a mechanical pencil with a ball-point pen integrally formed in one end thereof, a holder 5 for said writing utensil 4, which is fixable at a desired angle to form a stand, a note holder 7 placed in a binder mechanism 6 and a memo pad 8 (see FIG. 3) detachably attached to the inside of said body 1. Binder mechanism 6 is detachably retained in a channel portion 9 in body 1 by sliding latch 31, and includes rods 10 swingable apart from each other so hingedly separable so as to allow replacement of the note holder 7. Memo pad 8 is designed to be clampingly held, at its upper end, by an integrally formed resilient member 11. Writing utensil 4 has its main body serving as a mechanical pencil 12, and includes an integral miniature ball-point pen covered by a cap 13.

Figure 2:
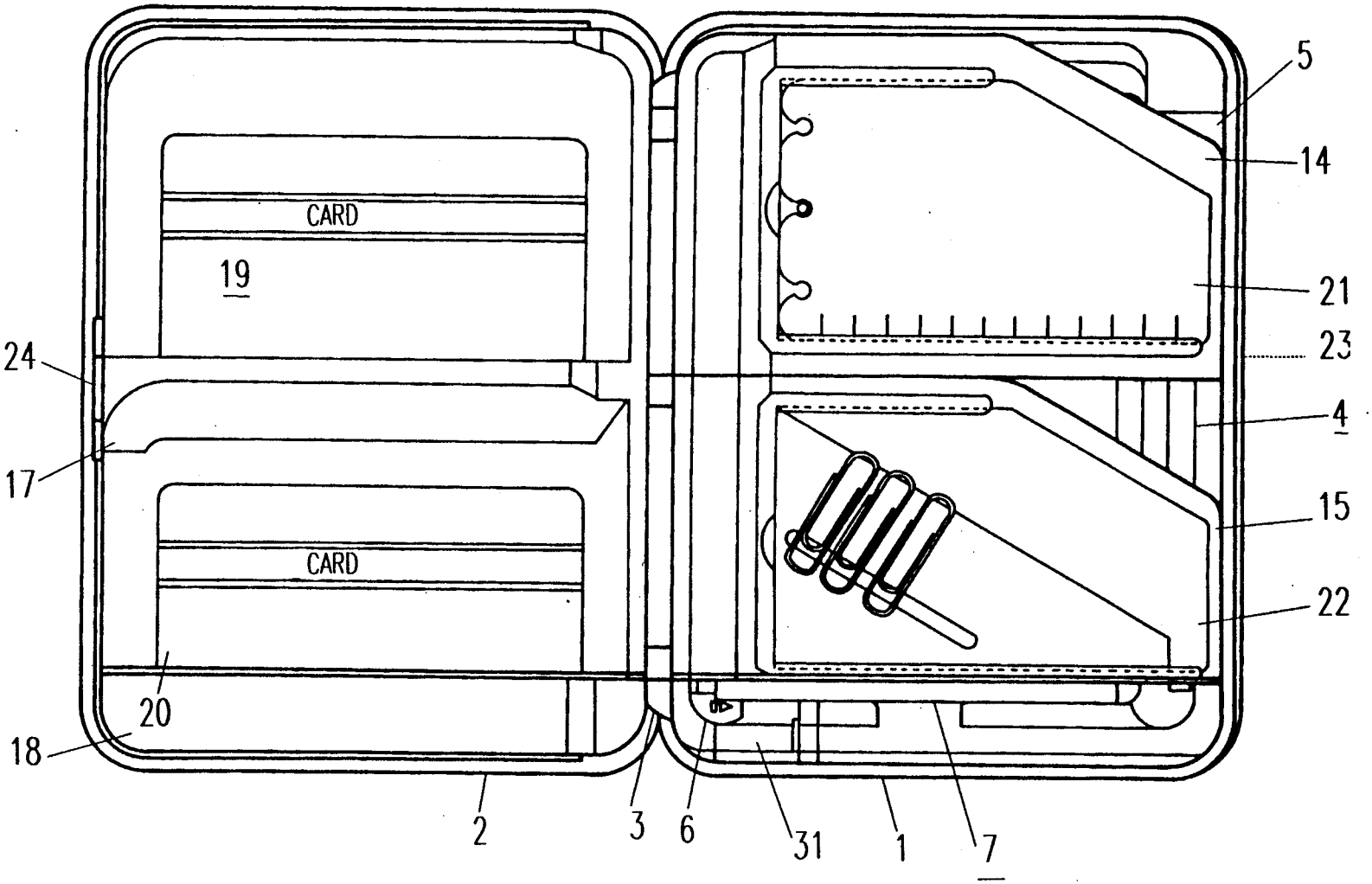
FIG. 2 is a front view of the packing kit of FIG. 1 in which the upper and lower packing bodies are turned over.

As illustrated in FIG. 1, lid member 2 includes upper and lower covering members 14 and 15 connected at 3 to body 1. Fingering cut-outs 16 allow covering members 14 and 15 to be conveniently opened, as illustrated in FIG. 2. As seen in FIG. 2, card-holding flanges 17 and 18, each of a suitable depth, into which cards 19, 20, etc. can be put are formed on the inside of lid member 2. On the back sides of cover members 14 and 15 there are a marker ruler 21 designed to be slidably removable therefrom and a holding piece 22 capable of holding clips, stamps and so on.

Mating male and female latch members 23 and 24 respectively are formed on the edges of body 1 and lid member 2.

While the present invention has been described with reference to one specific embodiment, various modifications and changes may be made within the scope of the invention which is limited only by the appended claims. For instance, the note holder may suitably be provided with a cover as well as plastic partitions 25 suitably inserted therein.

As mentioned above, the packing kit of the present invention is constructed is such a manner that a much larger number of various articles than contemplated in the prior art can be compactly packed in the body 1 and lid member 2, and that they can be easily removed therefrom. Thus, the articles can not only be used in a ready and fashionable manner, but the kit itself can be always carried in a compact manner for intended or desired use.

I claim:

1. A kit assembly for packing writing utensils and the like, comprising a body hingedly connected to a lid member, said body including a writing utensil, said writing utensil comprising a mechanical pencil having a ball-point pen integrally formed in one end thereof, a holder for said writing utensil, said holder including means fixable at a desired angle to form a stand, a note holder removably carried in a binder mechanism, and a memo pad detachably attached to the inside of said body, said lid member including upper and lower covering members hingedly connected to said body, pocket portions formed in said lid member adapted to receive cards, a marker ruler removably carried by a first one of said covering members and a holding piece for holding clips, stamps and so on carried on a second one of said covering members, and which further includes mating male and female latch members formed on the edges of said body and said lid member.

2. A kit assembly according to claim 1, wherein said body includes means defining a channel, and said kit assembly further includes means for detachably mounting said binder mechanism in said channel, said binder mechanism including rods hingedly separable so as to allow replacement of a note pad.

3. A kit assembly according to claims 1 or 2, wherein said note holder is provided with a cover and plastic partitions suitably inserted therein.

* * * * *